United States Patent [19]

Robinson

[11] 4,075,983

[45] Feb. 28, 1978

[54] ELECTRONIC CIRCUITRY FOR MAINTAINING CONSTANT ENGINE SPEED FUEL INJECTION

[75] Inventor: Harold R. Robinson, Washington, D.C.

[73] Assignee: The United States of America as represented by the Secretary of the Army, Washington, D.C.

[21] Appl. No.: 717,724

[22] Filed: Aug. 25, 1976

[51] Int. Cl.[2] ..... F02B 3/00

[52] U.S. Cl. ..... 123/32 EA; 123/102

[58] Field of Search ..... 123/32 EA, 102, 139 E

[56] References Cited

U.S. PATENT DOCUMENTS

| | | | |
|---|---|---|---|
| 3,338,221 | 8/1967 | Scholl | 123/32 EA |
| 3,566,846 | 3/1971 | Glockler | 123/32 EA |
| 3,695,242 | 10/1972 | Tada | 123/102 |
| 3,886,921 | 6/1975 | Hafner | 123/102 |
| 3,938,611 | 2/1976 | Bertolasi | 123/102 |

*Primary Examiner*—Ronald B. Cox

*Attorney, Agent, or Firm*—Nathan Edelberg; Robert P. Gibson; Saul Elbaum

[57] ABSTRACT

Electrical signals from a vehicle distributor are processed by a pulse generating circuit. Generated pulses are integrated to form an analog signal which is linearly proportional to engine speed. The analog signal is algebraically summed with an analog signal derived from a vehicle accelerator pedal. A resultant summed signal is fed to a voltage controlled one-shot which produces output pulses having a constant amplitude with a frequency proportional to the engine speed. The width of each pulse is inversely proportional to the engine speed. The integral or the area under the pulses derived from the voltage controlled one-shot remains constant, the pulses being fed to a fuel injector that injects fuel into a vehicle carburetor in a manner maintaining a constant engine speed regardless of load.

5 Claims, 1 Drawing Figure

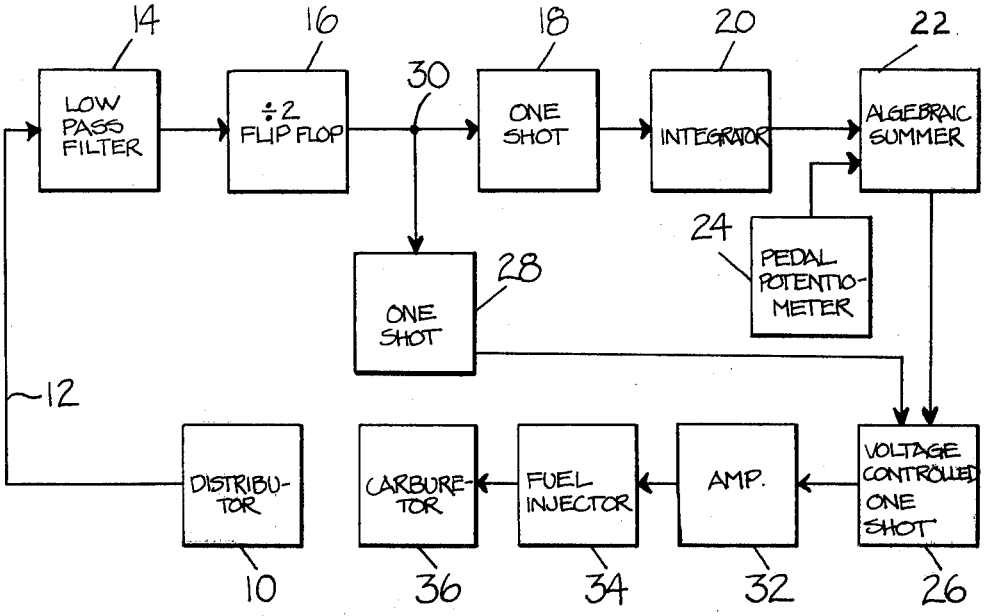
14
16
18
20
22
30
LOW PASS FILTER
÷2 FLIP FLOP
ONE SHOT
INTEGRATOR
ALGEBRAIC SUMMER
24
PEDAL POTENTIO-METER
28
ONE SHOT
12
DISTRIBU-TOR
CARBURE-TOR
FUEL INJECTOR
AMP.
VOLTAGE CONTROLLED ONE SHOT
10
36
34
32
26

ELECTRONIC CIRCUITRY FOR MAINTAINING CONSTANT ENGINE SPEED FUEL INJECTION

RIGHTS OF THE GOVERNMENT

The invention described herein may be manufactured, used, and licensed by or for the United States Government for governmental purposes without the payment to me of any royalty thereon.

FIELD OF THE INVENTION

The present invention relates to a fuel injection system for internal combustion engine vehicles and more particularly to such a system which has the configuration of a closed feedback loop for maintaining constant engine speed regardless of load or road speed.

BRIEF DESCRIPTION OF THE PRIOR ART

In recent years, a great many approaches have been taken in the application of fuel injection systems for internal combustion engines. Generally, the purpose of these systems is to maintain a constant air/fuel ratio. The relative merits of fuel injection systems for increasing the performance capability of the vehicles is well known. However, even with prior art fuel injection systems, the engine speed of the vehicle varies greatly as the road load is applied to the vehicle. Thus, the engine speed will decrease sharply when the vehicle climbs hills and will conversely increase when descending hills. Further, during acceleration the engine speed is increased or the opposite pertains during deceleration. In the prior art there has been a general lack of recognition that combustion efficiency, operating characteristics and engine life is decreased as the engine speed of the vehicle undergoes great variations as the vehicle is operated. Accordingly, it is desirable to achieve the beneficial effects of a fuel injection system which is capable of maintaining a constant energy speed during the wide variations of operation for a vehicle.

BRIEF DESCRIPTION OF THE PRESENT INVENTION

The present invention achieves the aforementioned constant vehicle engine speed during operation by ensuring that fuel injection pulses maintain a constant integral. In effect, the present invention is analogous to a speed control system utilizing servo-mechanisms.

Maintaining constant engine speed is of particular significance in heavy duty vehicles including military vehicles such as jeeps, which undergo great variations in load torque during passage of various terrains. Thus, by maintaining constant engine speed for a vehicle, the benefits of efficient operation may be realized in addition to greater reliability and longer engine life. This obviously decreases the maintenance required of the vehicle which is of particular significance for military vehicles that operate in the field.

BRIEF DESCRIPTION OF THE FIGURE

The above-mentioned objects and advantages of the present invention will be more clearly understood when considered in conjunction with the accompanying drawing, in which:

The FIGURE is a block diagram of the present fuel injection system.

DETAILED DESCRIPTION OF THE INVENTION

Referring to the FIGURE, reference numeral 10 is seen to generally indicate a spark plug distributor from which signals may be derived indicative of spark plug firings. These signals are fed along lead 12 to a conventional low pass filter 14 which rids the signal present on lead 12 of noise spikes. The output from the low pass filter feeds a conventional divide-by-2 flip-flop circuit 16 which divides the frequency of pulses derived from low pass filter 14 so that a reasonable frequency of fuel injection may be realized at the injector valve to be discussed hereinafter. The output from the divider flip-flop 16 is fed to a one shot 18 operating as a tachometer circuit. The purpose of the one shot is to create constant pulse width from the signal derived at the output of flip-flop 16. This is necessary to achieve linear changes in pulse frequency as a function of engine speed. The output from the one shot 18 is fed to an integrator 20 which converts the pulse signal at the input thereof to an analog signal exhibiting voltage variations as a function of engine speed. A typical integrator is available from the Fairchild Corp. and is identified by model number 74123. The output from integrator 20 will be greater as engine speed increases which tends to produce a greater number of pulses originally generated at the input of integrator 20 which would necessarily tend to increase the proportional analog voltage output of the integrator 20. However, as will now be explained, subsequent circuitry in the system tends to stabilize this situation to achieve a constant engine speed.

An algebraic summer 22 has a first input derived from the integrator 20 while a second input is derived from a potentiometer 24 which produces a signal directly corresponding to the position of a vehicle accelerator pedal as depressed by the vehicle operator. A greater signal is produced when the accelerator pedal is further depressed. As a result, the algebraic summer 22 generates a voltage output dependent upon two parameters. The first being engine speed at a particular point in time, the second parameter being the vehicle operator's demand for greater or lesser power. A suitable algebraic summer is typified by a device manufactured by Analog Devices, Inc., and is a type of operational amplifier specified as Model UA747.

The output from the algebraic summer 22 is connected to a first input of a voltage controlled one shot 26. A second input to this one shot is derived from an ordinary one shot 28 connected at its input to the node 30 defined between the output of flip-flop 16 and the input of the one shot (tachometer) 18. In essence, the primary signal input to the voltage controlled one shot 26 is derived from the ordinary one shot 28 which corresponds to the pulses derived from the distributor 10. Negative feedback is achieved by introducing a voltage control signal from the algebraic summer 22 to the voltage controlled one shot 26. By virtue of the negative feedback in the circuit loop, as a demand is made by a vehicle operator for greater power by pressing an accelerator pedal, the output from the algebraic summer will initially increase, which decreases the pulse width of the pulses derived from the voltage controlled one shot 26. Although there will be a greater number of pulses generated from the voltage controlled one shot 26 in these circumstances, their duration will be shorter to achieve a constant integral or area under the curve of the pulse output from voltage controlled one shot 26.

This will tend to equalize the engine speed even under greater demand by the operator in a manner achieving relatively constant engine speed.

Conversely, if a vehicle operator lets up on a vehicle accelerator, the algebraic summer 22 will respond by generating a smaller voltage at its output to the voltage controlled one shot 26. This will cause an inversely proportional effect upon the pulse width at the voltage controlled one shot output. More particularly, the duration of the pulses generated by the voltage controlled one shot 26 will increase even though the frequency of pulse generation decreases. As a result, the integral or area under the curve of the pulses derived from the voltage controlled one shot 26 will again remain constant to ensure a constant vehicle engine speed.

An amplifier 32 amplifies the signals from the voltage controlled one shot 26 and controls a fuel injector valve 34 of the type manufactured by the Bosch Corporation and is used in a fuel injection system for conventional automobiles such as the Volkswagon. The injector valve 34 produces pulsed fuel injections to a carburetor 36 as a fluidic analog of the electrical pulses delivered by the voltage controlled one shot 26 via amplifier 32, which may typically be of the type manufactured by Signetics Corp. and identified by Model NE555.

Thus, as will be appreciated from the above description of the invention, a closed loop system controls the fuel injection to a carburetor so that a constant engine speed is maintained throughout the variations in vehicle operation.

I claim the following:

1. A fuel injection control circuit for an internal combustion engine having ignition distributive means and comprising:

means connected to the output of the distributive means for generating a pulse signal having a frequency directly proportional to engine speed;

a first one shot multivibrator circuit responsive to the output of the generating means for regulating the pulse signal to ensure pulses of constant width;

means connected to the output of the first multivibrator circuit for integrating the output therefrom;

means responsive to an engine operator for producing a signal directly proportional to the position of an accelerator pedal;

means for algebraically summing the outputs of the integrating means and the operator responsive means for generating a control signal;

a voltage controlled one shot multivibrator circuit having a first triggering input furnished by a second one shot multivibrator circuit connected to the generating means output and a second input carrying the control signal for producing pulses having pulse width inversely proportional to the amplitude of the control signal; and injection means connected to the output of the voltage controlled multivibrator circuit for fluidically delivering pulses of fuel corresponding to the output pulses from the voltage controlled multivibrator circuit;

whereby the operating speed of the engine is maintained relatively constant.

2. The subject matter set forth in claim 1 together with a low pass filter connected between the output of the distributive means and the input of the generating means for filtering high frequency noise spikes from the distributive means output.

3. The subject matter set forth in claim 2 wherein the generating means is a divider flip-flop which reduces the frequency of the generating means output.

4. The subject matter set forth in claim 3 wherein the operator responsive means is a pedal actuated potentiometer having its output connected to the summing means.

5. The subject matter set forth in claim 4 together with amplifying means connected between the output of the voltage controlled one shot multivibrator and the injection means.

* * * * *